United States Patent [19]

Moore

[11] 4,403,274

[45] Sep. 6, 1983

[54] PORTABLE LAMP

[75] Inventor: Arthur H. Moore, Fairfield, Conn.

[73] Assignee: The Bridgeport Metal Goods Mfg. Co., Bridgeport, Conn.

[21] Appl. No.: 222,932

[22] Filed: Jan. 6, 1981

[51] Int. Cl.[3] ..... F21L 7/00; F21L 19/00

[52] U.S. Cl. ..... 362/186; 362/196

[58] Field of Search ..... 362/196, 186

[56] References Cited

U.S. PATENT DOCUMENTS

| | | | |
|---|---|---|---|
| 2,264,145 | 11/1941 | Chilo | 362/417 |
| 2,591,112 | 4/1952 | Zwierzynski | 362/196 |
| 2,651,710 | 9/1953 | Clark | 362/196 |
| 3,821,540 | 6/1954 | Watt | 362/186 |
| 4,079,243 | 3/1978 | Pemberton | 362/186 |

OTHER PUBLICATIONS

Sears Rec. Vehicles Catalog, 1982 Edition, Sears Roebuck Co., p. 31.

*Primary Examiner*—Irwin Gluck
*Attorney, Agent, or Firm*—Cifelli, Frederick & Tully

[57] ABSTRACT

A portable lamp is comprised of two formed plastic housing halves which are secured together by the engagement of headed projections extending from one of the housing halves and received over flanges in the other of the housing halves. The portable lamp is "wired" by a plurality of metal conductor strips and a switch supported in one of the housing halves, one strip extending from a bulb mounted in a plastic bulb socket formed by the assembled housing halves to one terminal of the battery, another strip extending from the other terminal of the bulb to and contacting a first exposed terminal of the switch and another strip extending from the other terminal of the switch to an annular metal disc which receives the other battery terminal. The switch and metal conductor strips and annular discs are held in position by internal rib structures when the housing halves are assembled together. The base further comprises a bottom cap received in bayonet mounting on the bottom of the assembled housing halves, thereby providing access to the battery. The base supports a shade and shade bail, and more particularly each of the housing halves defines vertical flanges which together define two opposed vertical grooves in the assembled base, and each of the housing halves include projecting tongues which overlap to form the base of the vertical grooves. Openings extend through the tongues of both of the housing halves for receiving the inturned ends of the shade bail, wherein the shade bail contributes to the structural integrity of the base. The vertical flanges further define at least two parallel inclined grooves which support the shade bail and the shade at an inclined angle with respect to the base.

9 Claims, 6 Drawing Figures

PORTABLE LAMP

BACKGROUND OF THE INVENTION

This invention relates to a portable lamp and more particularly to advantageous construction and features in a portable lamp.

Portable battery-powered lamps are generally known in the art and are useful in that they provide a self-contained light source. They are useful in many situations, such as outdoors for camping, boating, etc. and indoors during power outages and the like.

Known portable lamps generally comprise a base adapted to sit on a flat surface, the base enclosing a battery. The base includes a bulb socket mounting a bulb, wiring and a switch for controlling operation of the bulb. Known portable lamps further include a shade bail detachably mounted to the base and supporting a shade surrounding the bulb, and vertical height adjustment of the shade bail is usually provided. Several features of the prior art portable lamps make them expensive to manufacture. The bases are manufactured of a plurality of molded plastic parts which are assembled with screws, wherein each screw must be inserted and tightened individually in the manufacturing process. A metal bulb socket must also be placed and secured in position, which not only increases manufacturing costs but also has a potential for rust and corrosion. The bulb socket, switch and battery are electrically connected by insulated wire, requiring connections made by soldering, riveting or the like, as desired, all of which are relatively expensive manufacturing techniques.

SUMMARY OF THE INVENTION

A portable lamp according to the invention herein has a base formed from two housing halves joined along a vertical section line, at least one of the housing halves being provided with headed projections received in snap action engagement by the other half in order to assemble the housing halves together without benefit of screws or other fasteners. The base includes a bottom cap, which is removable to provide access for battery replacement, the bottom cap being secured to the assembled housing halves by bayonet mounting action. In the preferred embodiment, the base has an oval sectional shape, and stops in the bayonet mounting structure align the oval bottom cap with the oval housing.

At its upper portion, the base defines a neck which mounts a shade bail and shade. The neck defines opposed vertical grooves having vertically spaced apart openings receiving in-turned ends of the bail. Thus, the shade bail and shade supported on it may be vertically adjusted by selecting the openings in which the shade bail is inserted. The neck further defines parallel opposed inclined grooves intersecting the vertical grooves with the axis of the inclined grooves also intersecting one pair of shade bail mounting holes. Thus, the shade bail can be positioned in the inclined groove to support the shade in a tilted position. The vertical grooves defined in the neck of the base are preferably formed at the juncture between the two halves of the base, and more particularly the two halves have overlapping tongues forming the bottom of the groove, wherein the ends of the shade bail extend through the overlapped tongues of both housing halves, the ends of the shade bail thereby in part contributing to the structural integrity of the portable lamp.

The neck of the base also defines a bulb socket for bayonet mounting of the bulb. The juxtaposed base halves each have inwardly projecting rib structure defining grooves arranged to provide the bayonet mounting of the bulb, thus avoiding a metal bulb socket for this purpose.

According to an additional feature of the invention herein, metal contact strips are used to make connections within the base of the portable lamp. More particularly, a bulb-to-battery contact strip extends into the plastic bulb socket for making electrical contact with the tip of the bulb received therein, and extends from the bulb socket to engage one terminal of the battery. A bulb-to-switch metal contact strip leads to one side of a switch. The switch is received in a rectangular switch cavity defined within the housing, and may be a conventional pushbutton switch having terminals on the switch housing to which wires are normally soldered. In the portable lamp of the invention herein, the bulb-to-switch metal contact strip extends into the rectangular cavity and contacts one terminal of the switch by spring friction pressure. A third switch-to-battery metal contact strip engages the other switch terminal and leads to an annular ring which in turn is contacted by the second terminal of the battery. The metal contact strips, which serve to "wire" the portable lamp, are all mounted in slots, grooves, etc. formed in one of the housing halves, and are retained in position by the other of the housing halves when the housing halves are snapped together.

Accordingly, the principal object of the invention herein is to provide an improved portable lamp.

It is an additional object of the invention herein to provide a portable lamp characterized by simplicity and economy in manufacturing.

It is a further object of the invention to provide a portable lamp with additional convenience features.

Other features and objects of the invention herein will in part be obvious and will in part appear from a perusal of the following description of the preferred embodiments and claims, taken together with the drawings.

DRAWINGS

The same reference numerals refer to the same elements throughout the various figures.

DESCRIPTION OF PREFERRED EMBODIMENT

Figure 1:
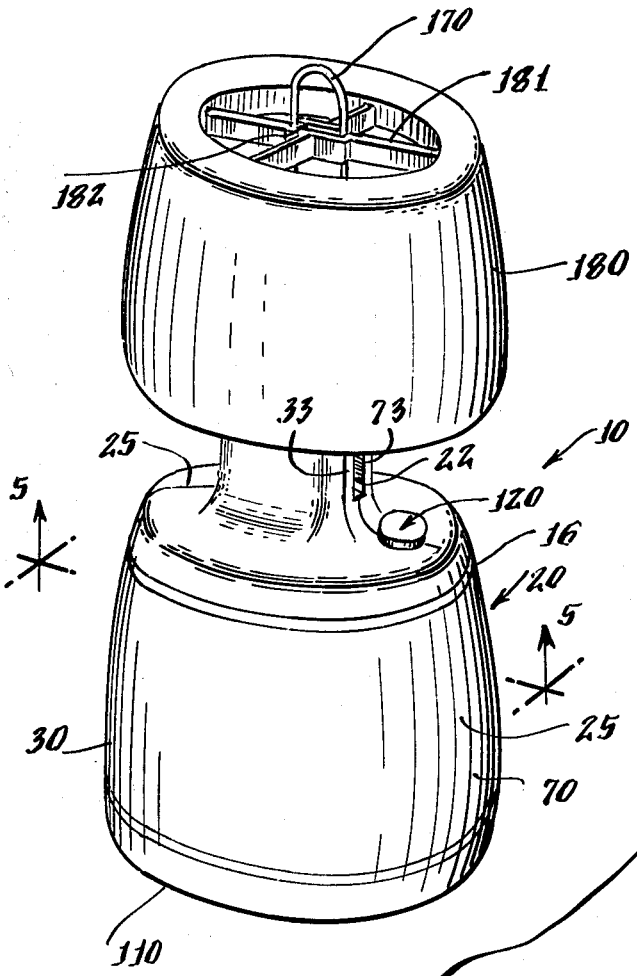
FIG. 1 is a perspective view of a portable lamp according to the invention herein.

With reference to FIG. 1, there is shown in perspective a portable lamp 10 according to the invention herein, and the remaining figures show structural details of portable lamp 10. The portable lamp 10 generally comprises a base 20 which includes two housing halves 30 and 70 joined together by snap action along a vertical section line and a removable bottom cap 110 which is removable for inserting and removing a battery into the base 20. The base 20 defines a bulb socket 100 for bayonet mounting of a bulb 190, encloses and supports a battery 195, and further includes metal conductor strips supported within the base to connect the battery to the bulb through a switch 120 operable from the exterior of the base. The portable lamp 10 further comprises a shade bail 170 and shade 180, the shade bail being detachably mounted to the base for supporting the shade at adjustable heights with respect to the base, and the base also providing for supporting the shade bail and shade at an angle for directing light from the bulb.

Figures 3, 5, 6:
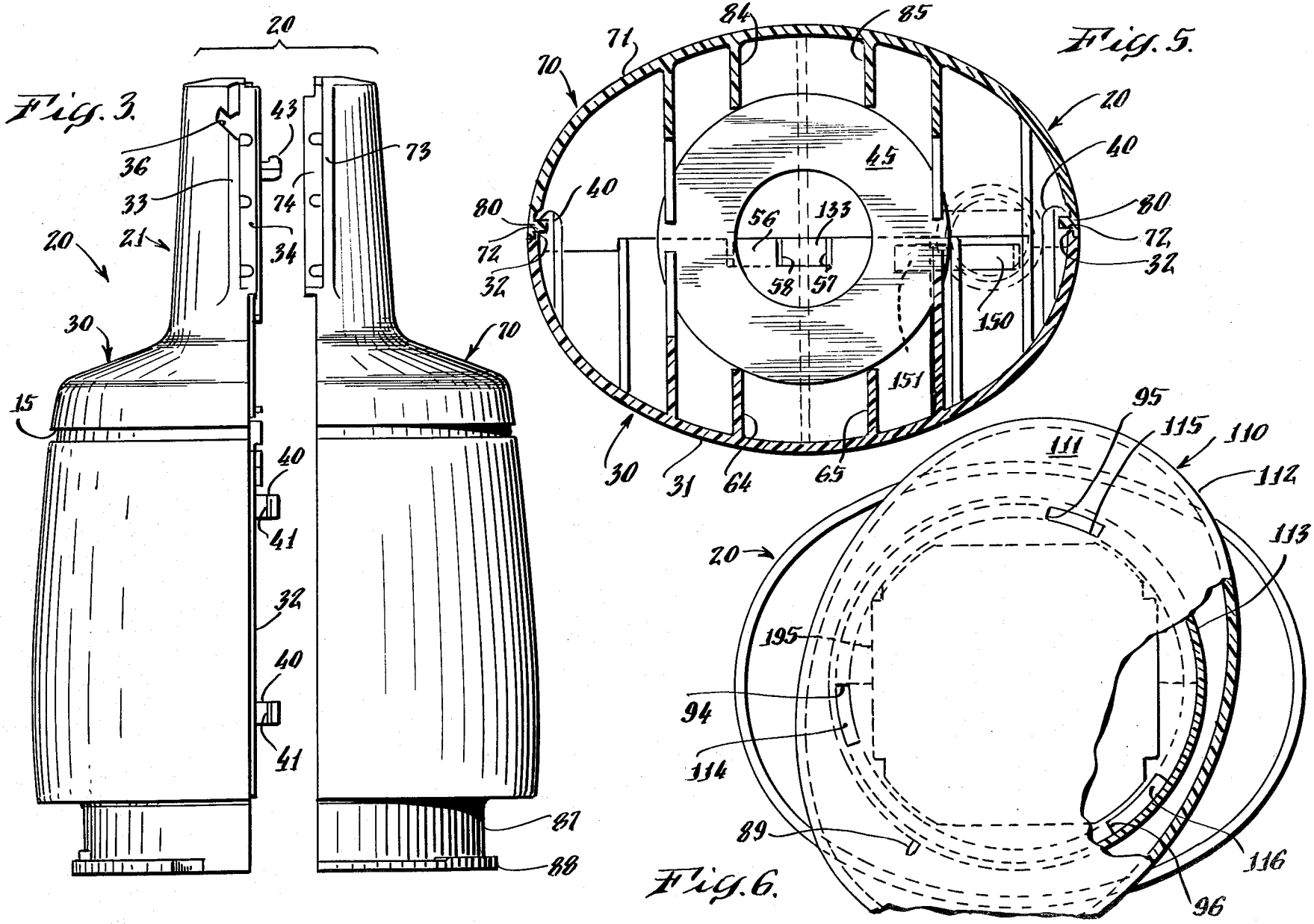
FIG. 3 is a side elevation view of the housing halves of the base of the portable lamp, shown separated.
FIG. 5 is a sectional view of the portable lamp taken along the lines 5–5 of FIG. 1.
FIG. 6 is a bottom view of the portable lamp of FIG. 1 showing the bottom cap mounting.

As best seen in FIGS. 1, 5 and 6, the base 20 in the preferred embodiment has an oval sectional configuration with a relatively large lower portion housing the battery and a thinner upper neck 21 and the two housing halves 30 and 70 are joined along a vertical line 25 at approximately the tips of the oval. The housing halves are preferably molded plastic parts. The housing half 30 accordingly has a shaped wall 31 providing the exterior surface of a substantial portion of the base, including half of the neck of the base. The housing half 50 similarly has a shaped exterior wall 51. Below the neck of the base, the housing half 30 has a tongue 32 extending from its vertical edge and offset from the outside surface. The housing half 70 has a groove 72 along its vertical edge, and the tongue 32 extends into the groove 72 to provide an overlapping joint between the housing halves which is resistant to the ingress of dirt and water, best seen in the sectional view of FIG. 5.

Figure 2:
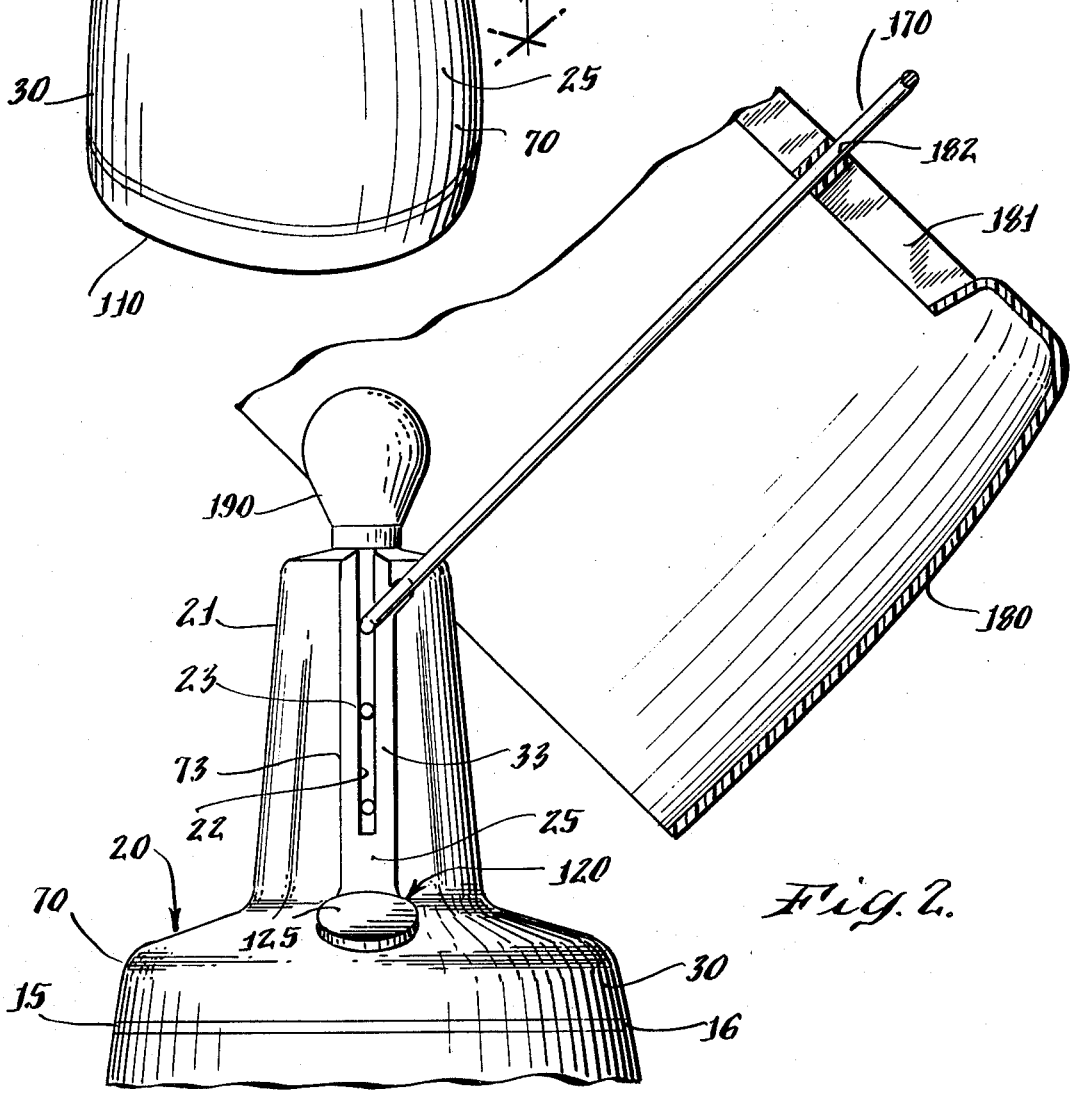
FIG. 2 is a side elevation view, partially cut away, of the portable lamp showing its shade inclined.

The neck 21 of the base 20 is adapted to receive and mount the shade bail 90 and shade 95, and with reference to FIG. 2, the neck 21 of the base 20 has two opposed vertical grooves 22 (only one of which is visible in FIG. 2) each groove being defined between vertical flanges 33 and 73. More particularly, the housing half 30 has the vertical flange 33 integrally formed therewith and further has a protruding tongue 34. The housing half 30 defines a groove 35 adjacent to tongue 34 and extending under the vertical flange 33. The other housing half 70 defines the vertical flange 73, and also has a tongue 74 which overlaps the tongue 34 and extends into groove 35 of the base half 30 when the base halves are assembled together. The tongues 34 and 54 each define a plurality of vertically spaced-apart openings 23, which are registered when the base is assembled to receive the shade bail. Additionally, the vertical flange 33 defines an inclined slot 36 the axis of which passes through the uppermost of the openings 23, as best seen in FIGS. 2 and 3, and permits the shade bail and shade to be supported at an inclined position, as more fully discussed below.

The housing halves 30 and 70 are assembled together without benefit of screws or other additional fasteners, and more particularly, the housing half 30 is provided with a plurality of headed projections 40 which protrude from its vertical edges, each of the headed projections 40 defining a surface 41 adjacent the enlarged head. An additional headed projection 43 extends from a horizontal wall 50 disposed across the neck forming a portion of the housing half 30. The housing half 70 is provided with inwardly protruding flanges 80 immediately adjacent its vertical edges and an additional flange 81 formed on a horizontal wall 90 aligned with wall 50 of housing half 30. Thus, the housing halves may be forced together and the headed projections 40, 41 snap over the flanges 80,81, thereby engaging with the flanges 80, 81 to hold the two housing halves in assembled condition. The headed projections 40,41 and flanges 80,81 are best seen in FIGS. 3 and 4, and the engagement of the headed projections 40 over the flanges 80 is best seen in FIG. 5.

Figure 4:
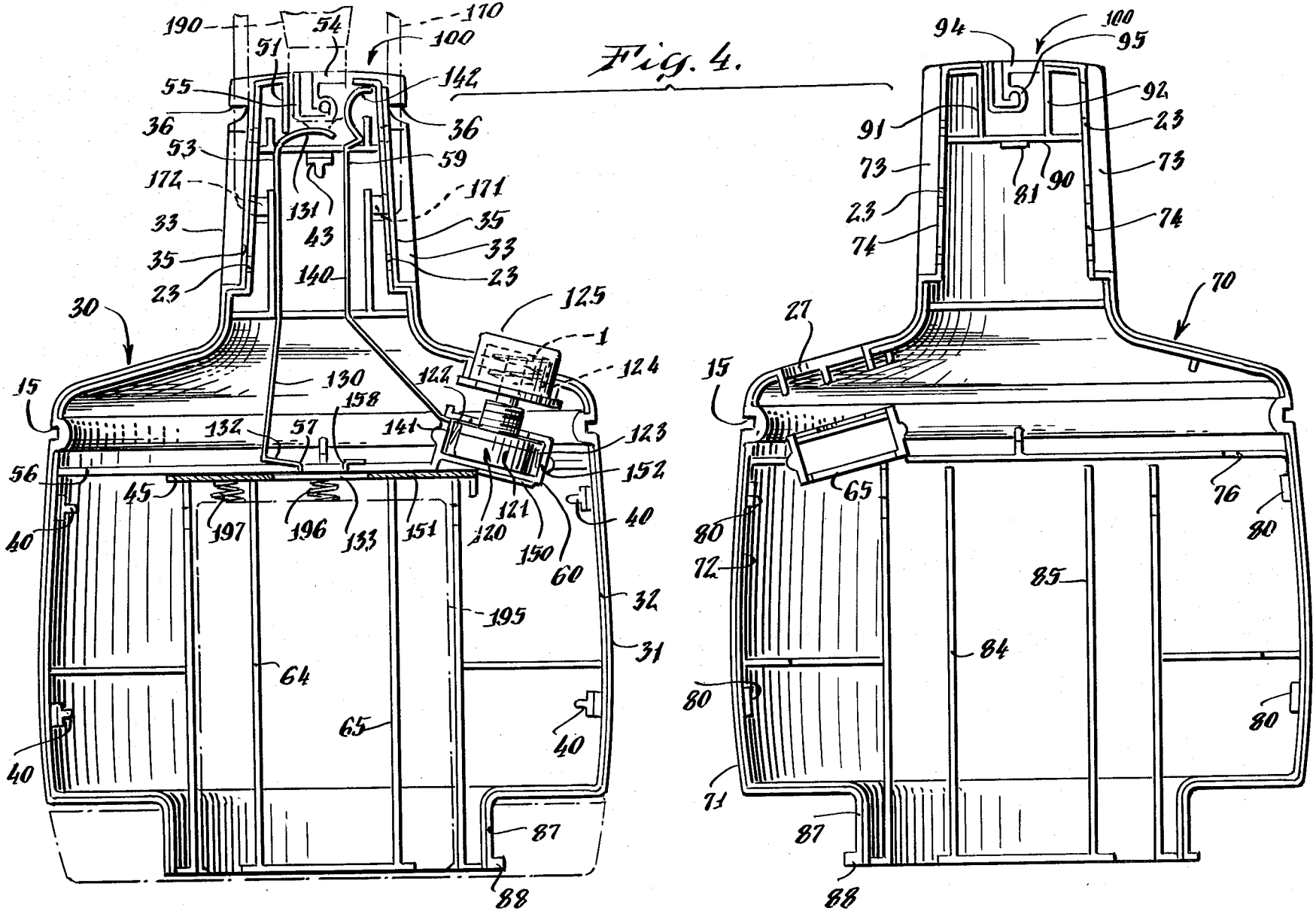
FIG. 4 is a side elevation view of the interiors of the housing halves of the base of the portable lamp.

With reference to FIGS. 4 and 5, the internal structure of the housing halves 30 and 70 of the portable lamp 10 is shown, including the bulb socket 100, means supporting the battery 195, the switch 120, and metal conductor strips. More particularly, according to the invention herein, the bulb socket 100 of the portable lamp 10 is formed of plastic integrally with the housing halves, and all of the electrical connections between the battery switch and bulb are achieved in an exceptionally economical and simplified manner.

The bulb socket for the portable lamp 10, generally designated at 100, is formed at the top of the neck 21 of the base 20. With reference to FIG. 4, the housing half 30 has horizontally disposed wall 60 extending across the neck, which, together with the horizontal plate 90 of the housing half 70, form the bottom of the bulb socket 100. Two vertically-oriented walls 51 and 52 of the housing half 30 form the sides of the bulb socket, together with the vertical walls 91 and 92 of the housing half 70. A semi-circular opening 54 is formed in the upper exterior wall of the housing half 30, and projecting from the exterior wall is a flange 55 defining an L-shaped groove comprising one side of a bayonet mount for the bulb 190. Similarly, the housing half 70 has a semi-circular opening 94 and a flange 95 forming the other L-shaped groove of the bayonet mount for the bulb 190. Thus, the side studs of the bulb 190 are received in the flanges 55, 95 and the round base of the bulb is encircled by openings 54, 94 of the bulb socket 100 to mount the bulb therein.

With further reference to FIG. 4, an elongated bulb-to-battery metal conductor strip 130 is positioned in a slot 53 in the horizontal wall 50 of the housing half 30, and has a free end 131 positioned at the bottom of the bulb socket 100 for resiliently contacting the tip of the bulb 190 and urging it upwardly to retain it in its bayonet mounting. The lower free end 132 of the metal conductor strip 130 is provided with an offset portion 133 received in slots 57, 58 formed in a horizontal rib 56 of housing half 30, the offset portion 133 being centrally located and adapted to receive one terminal 196 of battery 195.

The housing half 30 is further provided with a rectangular switch receiving cavity 60, the switch receiving cavity 60 comprising integral walls defining a rectangular cavity open at one side, as seen in FIG. 4. The switch 120 is mounted in the switch cavity 60. More particularly, the switch 120 comprises a rectangular body 121 having the switching mechanism therein, and two tab terminals 122 and 123 extending outwardly from the body 121. The switch 120 further comprises switch button 124 for making and breaking the switch connection, the switch button extending outwardly of the switch cavity 60 toward the exterior wall of the base. In the preferred embodiment, switch 120 is further provided with an auxiliary switch button 125 of larger size than switch button 27, the auxiliary switch button 125 being received in an opening 27 defined by semi-circular openings in each of the housing halves 30 and 70. Additional coil spring bias is also provided for the auxiliary switch button 125, and the switch button 125 has a flanged skirt which limits its upward travel to retain it in the base. A bulb-to-switch conductor strip 140 has one of its free ends 141 extending through a slot in the switch cavity 60, therein lying adjacent and making contact with the tab terminal 122 of the switch 120. The metal conductor strip 140 has its second free end 142 extending through a slot 59 in the horizontal bottom wall 50 of the bulb socket 100, the free end 142 being formed to make biased contact against the side of the base of the bulb 190.

The second terminal 197 of the battery 195 contacts an annular metal disc 45 which is supported between the horizontal rib 56 and the upper ends of vertical ribs 64, 65 extending outwardly from the side walls of the housing half 30. In addition to supporting the annular metal disc 45, these ribs also support and position the battery 195 within the base 20. A battery-to-switch metal conductor strip 150 has one free end 151 wedged between the horizontal rib 56 and metal disc 45, thereby making contact with the metal disc 45 and through it the battery terminal 197. The metal conductor strip 150 extends through a slot in the switch receptacle box 100, wherein the free end 152 of the metal conductor strip contacts the tab terminal 123 of the switch 120. Thus, when the switch 120 is closed, the metal conductor strips 130, 140 and 150, together with the annular disc 45 and the switch 120 establish an electrical circuit providing the current from the battery 195 to the bulb 190.

With further reference to FIG. 4, the housing half 70 also defines a portion 65 of the switch cavity 60, i.e., when the housing halves 30 and 70 are assembled together, the portion 65 completes the switch cavity 60, retaining the switch 120 and the free ends of the metal conductor strips 140 and 150 therein. The housing half 70 also has a horizontal wall 90 forming a portion of the bottom of the bulb socket aligned with the wall 50 of the housing half 30, wherein wall 90 retains the free ends of the metal conductor strips 130 and 140 in the positions shown. The housing half 70 further includes a plurality of ribs 84, 85 for positioning and supporting the battery within the base, and provides for accommodating the annular disc 75 between the tops of the vertical ribs 84, 85 and the horizontal rib 76, as perhaps best seen in FIG. 5. Other ribs shown in the drawing contribute to the structural rigidity of the base 20 of the portable lamp 10. Thus, when base halves 30 and 70 are assembled together, the metal conductor strips, annular metal disc and switch are all held in their operative positions.

The housing halves 30 and 70 of the base 20 may also define a peripheral groove 15 into which a rubber seal 16 is placed. The seal is in part decorative, but also assists in preventing water from running into the vertical joint 25 between the housing halves.

The bottom cap 110 is mounted to the remainder of the base 20 via a bayonet mounting, as best seen in FIGS. 3 and 6. The bottom cap 110 itself has a flat bottom wall 111 of oval configuration and a side wall 112 upstanding from the peripheral edge of the bottom wall 111. Also upstanding from the bottom wall 111 is a circular inner side wall 113, which is provided with three inwardly-extending tab projections 114, 115 and 116 spaced above the bottom wall 111. The tab 116 is wider than the other tabs for correctly positioning the bottom cap 110 on the base 20.

The base 20, when assembled, has a cylindrical depending wall 87 having an out-turned flange 88 at the end thereof. The flange 88 defines openings 94, 95 and 96 for receiving the tab projections 114, 115 and 116 of the bottom cap 110. The opening 116 being sized to receive the larger tab 116. Therefore, the bottom cap may only be positioned over the cylindrical wall 87 of the base 20 in proper orientation and the bottom cap is then rotated until tab 116 butts against a stop projection 89 formed on wall 87, at which time the oval outer side wall 112 of the bottom cap 110 is aligned with the exterior walls of the base 20, as best seen in FIG. 1. The bottom cap is, of course, removable for changing the battery.

The base 20 of the portable lamp 10 is assembled by inserting the annular metal disc 45, the metal conductor strips 130, 140 and 150 and the switch 120 into the housing half 30. The auxiliary switch and its biasing coil spring button 125 are also positioned on the switch button 124 and in the opening 27. The housing half 70 is then fitted onto the housing half 30, taking care to accommodate the annular disc 45 in its proper position, and the housing halves are snapped together to engage the headed projections 40, 43 with their flanges 80, 81. The rubber seal 16 is also installed in the peripheral groove 15 of the base. The battery 195 may be inserted into the base, and the bottom cap is mounted thereto. This completes the factory assembly of the portable lamp 10, since the bulb, shade bail and shade are usually installed by the user, and the battery may be installed by the user as well.

The shade bail 170 comprises a wire formed in a generally U-shaped configuration and including in-turned ends 171, 172. The shade 180 is a formed transluscent plastic piece having a cross-brace at 181 defining an opening 182, the opening 182 receiving the shade bail to mount the shade thereon. The in-turned ends 171, 172 of the shade bail 170 are inserted in selected ones of the openings 23 in the grooves 22 on the neck of the base, and the shade bail is formed such that its own spring tension holds its free ends in the openings 23. It should be noted that the ends 171, 172 of the shade bail extend through the overlapped tongues 34 and 74 of the housing halves 30 and 70, thereby assisting in holding the housing halves 30 and 70 together and reducing stresses on the headed projection 43 and flange 81. As is known in prior art, and shown in FIG. 1, the shade bail 170 is supported between the flanges 33 and 73 in order to hold the shade in its vertical orientation, with the height of the shade being adjustable by selecting the desired openings 23 in which the shade bail is mounted.

When the shade bail is in the uppermost of the openings 23, the shade bail can be pivoted to the inclined position shown in FIG. 2, wherein the shade bail is received and supported in the slot 36 defined by the vertical flange 33. When the shade is so supported at an inclined angle, as illustrated in FIG. 2, the light from the bulb is permitted to shine directly upon the area adjacent the lamp. This is a desirable feature when using the lamp for reading or other tasks which require more than a diffused light.

Accordingly, there has been described a portable lamp which admirably achieves the objects of the invention herein. The manufacturing steps required to assemble the portable lamp 10 are highly simplified compared to prior art portable lamps using hard-wired electrical connections and screw or other assembly of the parts of the base, and the portable lamp 10 includes other desirable features as described above. It will be appreciated that various changes and modifications from the preferred embodiment described above can be made by those skilled in the art without departing from the spirit and scope of the invention, which is limited only by the following claims.

I claim:

1. A portable lamp comprising a base including two molded plastic housing halves secured together along generally vertical joints by snap action engagement of headed projections extending from one of the housing halves over flanges deployed to receive the headed projections on the other of the housing halves, a molded plastic bottom cap removably mounted to the assembled housing halves, the base adapted for removably receiving a battery with access via said removable bottom cap. The base integrally defining a bulb socket adapted for removably receiving a bulb, each of the housing halves defining one L-shaped groove portion of a bayonet mount for the bulb wherein the L-shaped grooves are positioned for bayonet mounting of the bulb when the housing halves are assembled together, a bulb received in the bulb socket and a battery received in the base, and conductive means for supplying current from the battery to the bulb including switch means operable from the exterior of the base, and a bulb-to-battery metal conductor strip and a bulb-to-switch metal conductor strip, said metal conductor strips extending into the bulb socket to make contact with the bulb therein, and to bias the bulb into firm engagement with the bayonet mount.

2. A portable lamp as defined in claim 1 and further comprising a shade supported on a shade bail, the base being adapted to mount the shade bail by defining two vertical grooves receiving the shade bail, the two vertical grooves having openings therein for receiving the inturned ends of the shade bail, each of the two vertical grooves being defined by a vertical flange on each of the housing halves wherein the vertical flanges are deployed in vertical spaced-apart relationship when the housing halves are assembled together, each of the housing halves comprising a tongue wherein the tongues overlap when the housing halves are assembled together to form the base of the vertical grooves, the openings for receiving inturned ends of the shade bail extending through the overlapped tongues, whereby the shade bail upon insertion into the openings assists in maintaining the housing halves assembled together and reduces stress on the interengagement of the headed projections and flanges.

3. A portable lamp as defined in claim 2 wherein the vertical flanges of one of the housing halves define opposed and aligned inclined grooves, the axes of the inclined grooves intersecting the openings receiving the inturned ends of the shade bail, wherein the shade bail may be positioned in the inclined grooves to support the shade at an inclined angle.

4. A portable lamp as defined in claim 1 wherein the assembled housing halves have a non-circular horizontal cross-sectional shape adjacent the removable bottom cap, and the bottom cap is matingly configured and bayonet mounted at the bottom of the assembled housing halves to provide for inserting and removing the battery, the bayonet mount including a rotation limiting stop which aligns the matingly configured bottom cap with the assembled housing halves when the bottom cap is mounted thereto.

5. A portable lamp as defined in claim 1 wherein the means for supplying current from the battery to the bulb further comprises a switch-to-battery metal conductor strip and the plurality of metal conductor strips and a switch are all supported and positioned by rib means of the housing halves to make electrical contact between the battery and the bulb as controlled by the switch, the metal conductor strips positioned and supported in one of the housing halves and retained in position by the other housing half when the housing halves are assembled together.

6. A portable lamp as defined in claim 5 and further comprising a shade supported on a shade bail, the base being adapted to mount the shade bail by defining two vertical grooves receiving the shade bail, the two vertical grooves having openings therein for receiving the inturned ends of the shade bail, each of the two vertical grooves being defined by a vertical flange on each of the housing halves wherein the vertical flanges are deployed in vertical spaced-apart relationship when the housing halves are assembled together, each of the housing halves comprising a tongue wherein the tongues overlap when the housing halves are assembled together to form the base of the vertical grooves, the openings for receiving inturned ends of the shade bail extending through the overlapped tongues, whereby the shade bail upon insertion into the openings assists in maintaining the housing halves assembled together and reduces stress on the interengagement of the headed projections and flanges.

7. A portable lamp comprising a base including two molded plastic housing halves secured together, the two housing halves enclosing a battery and mounting a bulb in an integrally defined bayonet mount bulb socket, and wherein current is supplied from the battery through the bulb by:

(A) a bulb-to-battery metal conductor strip and integral molded plastic rib means in one of the housing halves supporting the bulb-to-battery metal conductor strip in position to make contact with a first battery terminal and one of the bulb terminals, the bulb end of the bulb-to-battery metal conductor strip extending into the integrally defined bayonet mount bulb socket;

(B) a switch supported in a switch cavity defined by one of the housing halves, the switch having a switch body and two exposed metal terminals;

(C) a bulb-to-switch conductor strip and integral molded plastic rib means in one of the housing halves supporting the bulb-to-switch metal conductor strip in position to make contact with the other terminal of the bulb and one of the exposed terminals of the switch, the bulb end of the bulb-to-switch metal conductor strip extending into the integrally defined bayonet mount bulb socket; and (D) a battery-to-switch metal conductor strip and integral molded plastic rib means in one of the housing halves supporting the battery-to-switch metal conductor strip in position with the second terminal of the battery and the other terminal of the switch, whereby the metal conductor strips and switch are placed in their positions prior to assembly of the housing halves together and are retained in their positions by the assembled housing halves, eliminating the need for wiring harnesses or the like in the portable lamp.

8. A portable lamp as defined in claim 7 wherein the battery-to-switch metal conductor strip contacts the battery terminal by contacting a metal annular disc supported in the housing halves, the metal annular disc being disposed to contact the second battery terminal.

9. A portable lamp as defined in claim 7 wherein the switch is a pushbutton operated switch including a pushbutton actuator mounted to a switch body and the portable lamp further comprises an auxiliary switch button mounted over the switch pushbutton and exposed on the exterior of the base of the portable lamp for operating the switch.

* * * * *